US008636145B1

(12) United States Patent
Toleski

(10) Patent No.: US 8,636,145 B1
(45) Date of Patent: Jan. 28, 2014

(54) PAINT CARRIER AND ORGANIZER

(76) Inventor: Steven A. Toleski, West Palm Beach, FL (US)

( * ) Notice: Subject to any disclaimer, the term of this patent is extended or adjusted under 35 U.S.C. 154(b) by 99 days.

(21) Appl. No.: 13/372,545

(22) Filed: Feb. 14, 2012

(51) Int. Cl.
*B65D 85/00* (2006.01)

(52) U.S. Cl.
USPC ..... 206/372

(58) Field of Classification Search
USPC ..... 206/361, 362.3, 15.2, 15.3, 811, 372, 206/373; 220/736; 182/129
See application file for complete search history.

(56) References Cited

U.S. PATENT DOCUMENTS 1,008,856 A * 11/1911 Mosher ..... 401/121
1,869,753 A * 8/1932 Kamm ..... 206/361
3,410,438 A * 11/1968 Bartz ..... 220/573
4,615,464 A * 10/1986 Byrns ..... 220/4.23
5,125,531 A * 6/1992 Wentz ..... 220/849
6,536,590 B1 * 3/2003 Godshaw et al. ..... 206/373
8,091,701 B1 * 1/2012 DePietro ..... 206/15.3
8,453,796 B2 * 6/2013 Astor et al. ..... 182/129

* cited by examiner

*Primary Examiner* — David Fidei
(74) *Attorney, Agent, or Firm* — Kyle Fletcher

(57) ABSTRACT

The paint carrier and organizer is a paint caddy that supplies paint from within a container, which can be sealed closed for storing paint and paint tools between uses. The paint carrier and organizer includes a container from which a hinged member rotates to either open and expose the contents therein or close forming a watertight seal so as to preserve paint therein. The container features paint tool-securing means along an interior and across a top thereof such that paint tools may be supported and stored therein and between use. At least one hook is provided such that the device may be supported upon a ladder rung. A plug is provided at or near a bottom portion of the container such that the contents may be removed. A removable storage container may be provided, which can attach along an exterior surface of the container for use in conjunction with painting.

13 Claims, 6 Drawing Sheets

PAINT CARRIER AND ORGANIZER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of painting tools and accessories, more specifically, a paint carrier and organizer.

B. Discussion of the Prior Art

As will be discussed immediately below, no prior art discloses a paint carrier and organizer that is capable of hooking upon a rung of a ladder, and which features a container that can store paint within; wherein the container includes a hinged member that can rotate outwardly in order to expose the interior of the container; wherein the hinged member includes a tongue and groove seal along the perimeter that marries up with the opening of the container in order to form a watertight seal when closed, which is secured via at least one sliding lock provided thereon; wherein an opening is provided along a top portion of the container to enable a paint roller to be supported therein while a brush is provided with at least one magnet for securement adjacent an interior of said container for storing thereto; wherein the container includes a drain plug that enables the contents to be disposed thereof; wherein a removable storage container may attach to an exterior surface of the container.

The Buckley Patent (U.S. Pat. No. 5,727,649) discloses a tool storage container that hooks onto a ladder. However, the tool storage container is not specifically adapted for use as a paint caddy that supplies and stores paint within a sealed container.

The Smith Patent (U.S. Pat. No. 5,603,405) discloses a tool box that attaches to a ladder. However, the tool box is not a paint caddy that can store and supply paint to paint tools, and which hooks upon a ladder rung.

The Misiukowiec et al. Patent (U.S. Pat. No. 5,493,751) discloses a paint roller pan having hooks for attachment to a ladder rung. However, the paint roller pan does not feature a container that can open and close to supply and store paint there from, and which includes means for storing paint tools along with a drain plug.

The Leffert et al. Patent (U.S. Pat. No. 3,837,034) discloses a painter's caddy having a bin for holding paint and a pair of handles. However, the painter's caddy does not include a container that can open or close to store or supply paint there from, and enable a paint brush or roller to be stored within between use.

The Golden et al. Patent (U.S. Pat. No. 3,707,242) discloses a multi-use paint tray that hooks onto the rung of a ladder. However, the paint tray does not seal close between use or open to expose paint container therein, and which includes means for storing paint tools between uses.

The Pharris Patent (U.S. Pat. No. 2,759,620) discloses a paint roller tray that can be attached to the rungs of a ladder. However, the paint roller tray is incapable of storing unused paint between uses, and does not provide a means for storing paint tools therein and in between uses.

The Schmid Patent (U.S. Pat. No. 5,079,795) discloses a painter's tray that attaches to the rungs of a ladder. Again, the painter's tray is incapable of storing unused paint between uses by providing a container that can seal close.

The Keane Patent (U.S. Pat. No. Des. 569,068) illustrates an ornamental design for a painting tray, which does not form a sealed container for storage of paint tools and paint therein and in between uses.

The Hoffert et al. Patent (U.S. Pat. No. Des. 444,604) illustrates an ornamental design for a paint tray with storable carrying handles, which does not depict a container for storing paint tools and paint in between uses.

While the above-described devices fulfill their respective and particular objects and requirements, they do not describe a paint carrier and organizer that is capable of hooking upon a rung of a ladder, and which features a container that can store paint within; wherein the container includes a hinged member that can rotate outwardly in order to expose the interior of the container; wherein the hinged member includes a tongue and groove seal along the perimeter that marries up with the opening of the container in order to form a watertight seal when closed, which is secured via at least one sliding lock provided thereon; wherein an opening is provided along a top portion of the container to enable a paint roller to be supported therein while a brush is provided with at least one magnet for securement adjacent an interior of said container for storing thereto; wherein the container includes a drain plug that enables the contents to be disposed thereof; wherein a removable storage container may attach to an exterior surface of the container. In this regard, the paint carrier and organizer departs from the conventional concepts and designs of the prior art.

SUMMARY OF THE INVENTION

The paint carrier and organizer is a paint caddy that supplies paint from within a container, which can be sealed closed for storing paint and paint tools between uses. The paint carrier and organizer includes a container from which a hinged member rotates to either open and expose the contents therein or close forming a watertight seal so as to preserve paint therein. The container features paint tool-securing means along an interior and across a top thereof such that paint tools may be supported and stored therein and between use. At least one hook is provided such that the device may be supported upon a ladder rung. A plug is provided at or near a bottom portion of the container such that the contents may be removed. A removable storage container may be provided, which can attach along an exterior surface of the container for use in conjunction with painting.

It is an object of the invention to provide a paint caddy that can attach upon a ladder rung, and which can store paint and paint tools therein and in between uses.

A further object of the invention is to provide a container that can open or close to supply or store paint, and which features a tongue and groove seal along the perimeter of an opening formed between the container and a hinged member.

A further object of the invention is to provide a sliding lock that can secure the hinged member against the container in order to secure a watertight seal formed at the tongue and groove seal.

A further object of the invention is to provide a plurality of paint tool securing means that are integrated within or atop of the container, which can store paint tools between use.

An even further object of the invention is to provide a drain plug at or along a bottom portion of the container such that paint may be extracted therefrom, and which may be used to wash out paint from within.

Another object of the invention is to provide a removable storage container that can attach itself along a front exterior of the container, and which may be used in storing tools associated with painting.

These together with additional objects, features and advantages of the paint carrier and organizer will be readily apparent to those of ordinary skill in the art upon reading the following detailed description of presently preferred, but nonetheless illustrative, embodiments of the paint carrier and organizer when taken in conjunction with the accompanying drawings.

In this respect, before explaining the current embodiments of the paint carrier and organizer in detail, it is to be understood that the paint carrier and organizer is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the paint carrier and organizer.

It is therefore important that the claims be regarded as including such equivalent construction insofar as they do not depart from the spirit and scope of the paint carrier and organizer. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
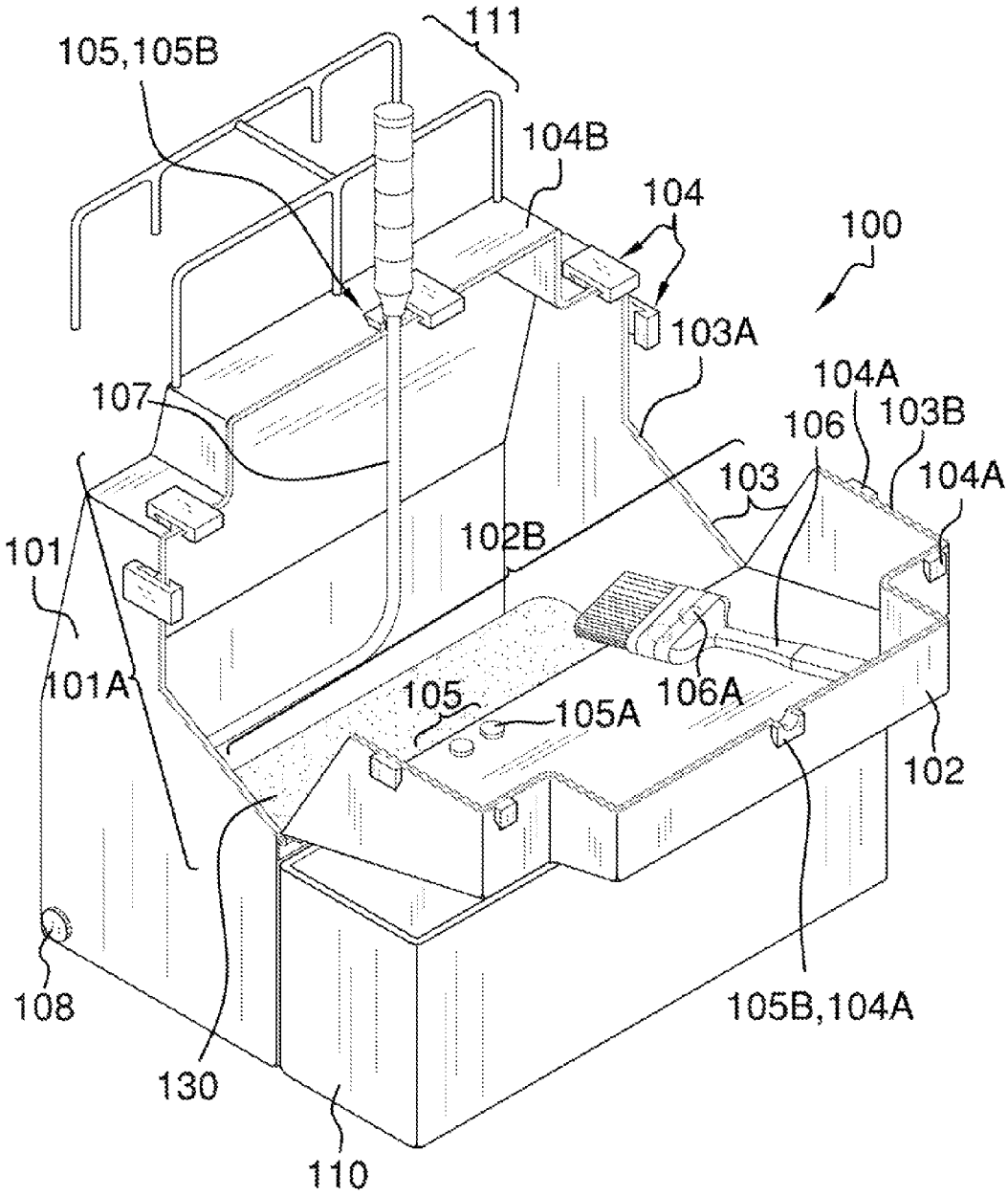
FIG. 1 illustrates a perspective view of the paint carrier and organizer wherein the hinged member is rotated outwardly thereby exposing the interior, and detailing the paint tool securing means used to support both a paintbrush and a paint roller therein.
Figure 2:
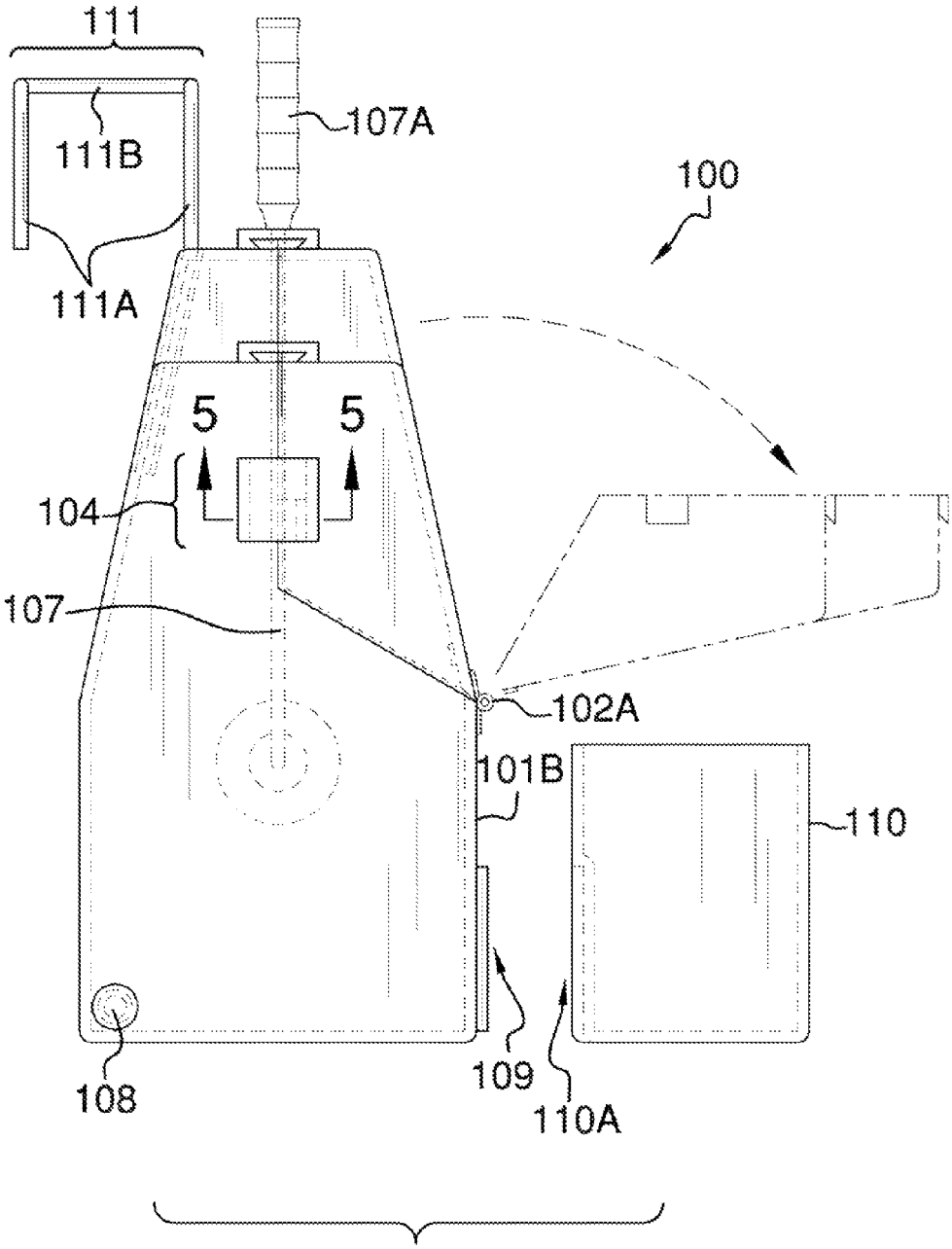
FIG. 2 illustrates a side view of the paint carrier and organizer in which detail is provided as to the rotation of the hinged member with respect to the container while depicting the paint roller extended therein and also detailing the removable storage container adjacent the container.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. A paint carrier and organizer 100 (hereinafter invention) includes a container 101 of hollow construction and including an opening 101A located along a top, front portion of the container 101. A hinged member 102 is connected to the container 101 via a hinge 102A. The hinged member 102 has a perimeter 102B defined by the opening 101A of the container 101 such that upon rotation to a closed position 13 (see FIGS. 2, 3, 6, and 7), the container 101 is closed.

More specifically, a tongue and groove seal 103 is provided along and between both the opening 101A of the container 101 and the perimeter 102B of the hinged member 102. When the hinged member 102 is rotated to close off the opening 101A of the container 101, a watertight seal is formed at the tongue and groove seal 103 such that any viscous materials provided therein are not allowed to escape through said opening 101A.

Ideally, the container 101 can store and supply paint 130 within for prolonged periods of time by simply sealing off the interior thereby minimizing exposure to ambient air, which would otherwise cause the paint to dry out within.

Adorning both the hinged member 102 and the container 101 is a plurality of sliding locks 104. The sliding locks 104 enables the invention 100 to be sealed off when the hinged member 102 is closed off with respect to the opening 101A of the container 101.

Figure 5:
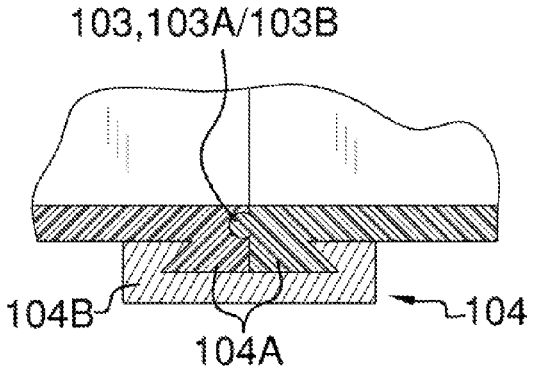
FIG. 5 illustrates a cross-sectional view of the paint carrier and organizer along line 5-5 in FIG. 2, and detailing the inter-relation of the container and hinged member along the tongue and groove seal, which is secured via a sliding lock.

The sliding locks 104 each include two protruding members 104A, which when pressed adjacent one another, enable a sliding member 104B to slide there over, and thereby prevent separation there between (see FIG. 5).

It shall be further defined that the tongue and groove seal 103 is composed of a tongue member 103A and a groove member 103B that can marry together in order to form the watertight seal described above. It shall be further noted that the tongue member 103A may be on either the container 101 or the hinged member 102; whereas the groove member 103B may be on either the hinged member 102 or the container 101, respectively.

The container 101 includes paint tool securing means 105 that are provided in or atop, and which enable paint tools to be secured and stored within the container 101 between use. More specifically, a paintbrush 106 may include at least one magnet 106A, which attracts to a magnet 105A provided along an interior surface of either the container 101 or the hinged member 102.

Figure 6:
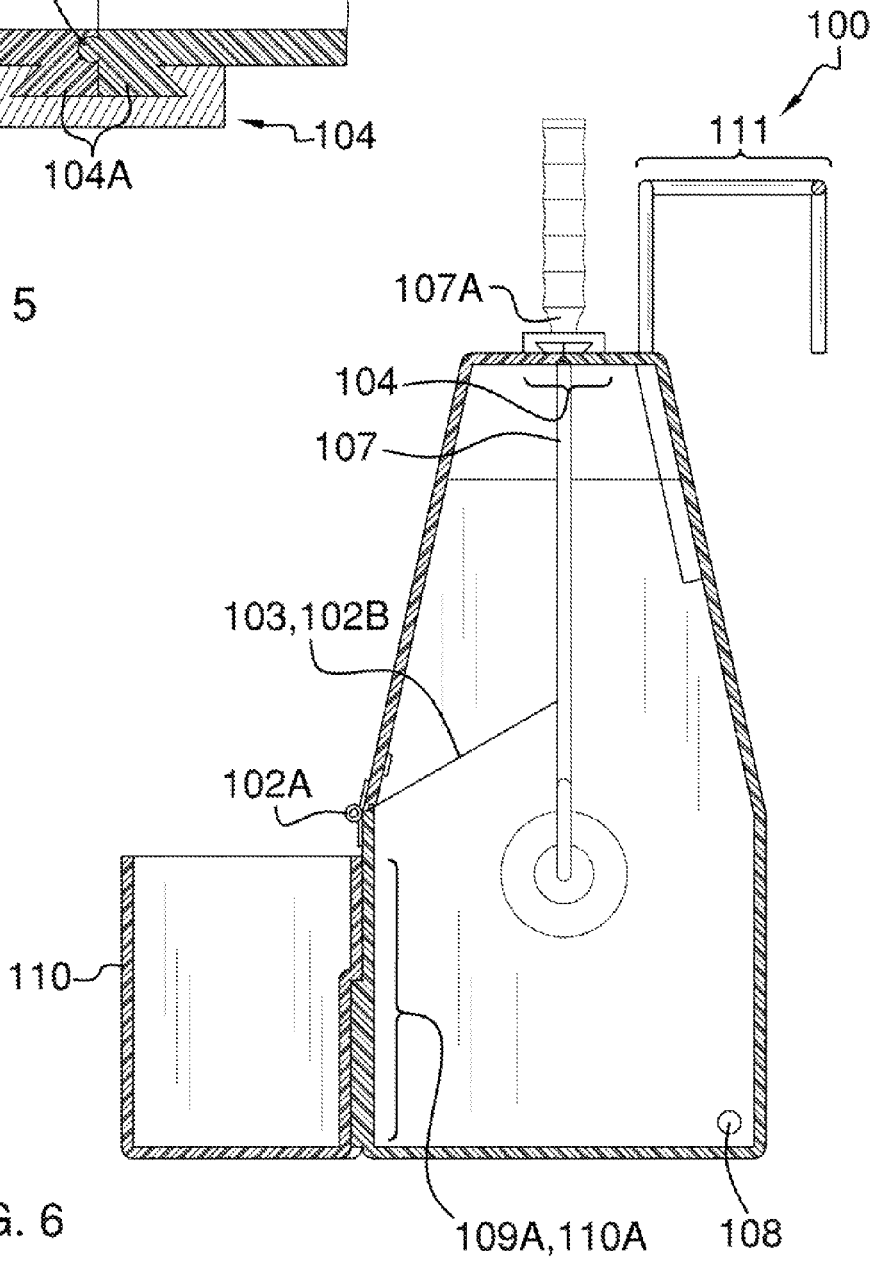
FIG. 6 illustrates a cross-sectional view of the paint carrier and organizer along line 6-6 in FIG. 4, and detailing the interplay between the removable storage container and the mounts along the front of the container.
Figure 7:
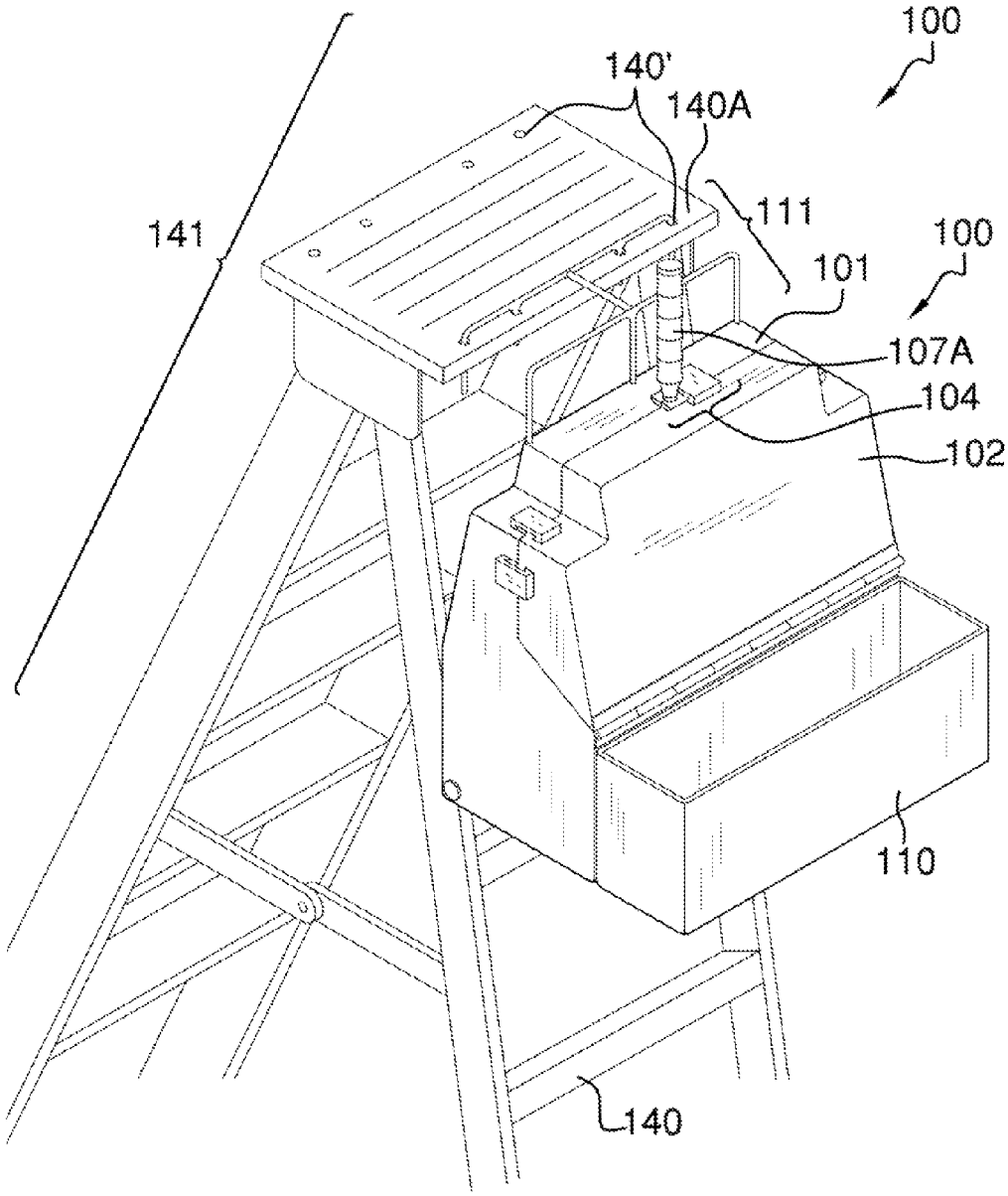
FIG. 7 illustrates a view of the paint carrier and organizer hooked upon a top rung of a ladder.

The paint tool securing means 105 may include a hole 105B formed between both the hinged member 102 and the container 101 such that a paint roller 107 may be secured and stored within the interior of the container 101 (See FIGS. 1 and 6). More specifically, the paint roller 107 is defined by a handle 107A that shall rest atop of the exterior surface of the invention 100 thereby enabling the remaining portion of the paint roller 107 to be descended and hung from below and within the interior of the invention 100.

Figure 3:
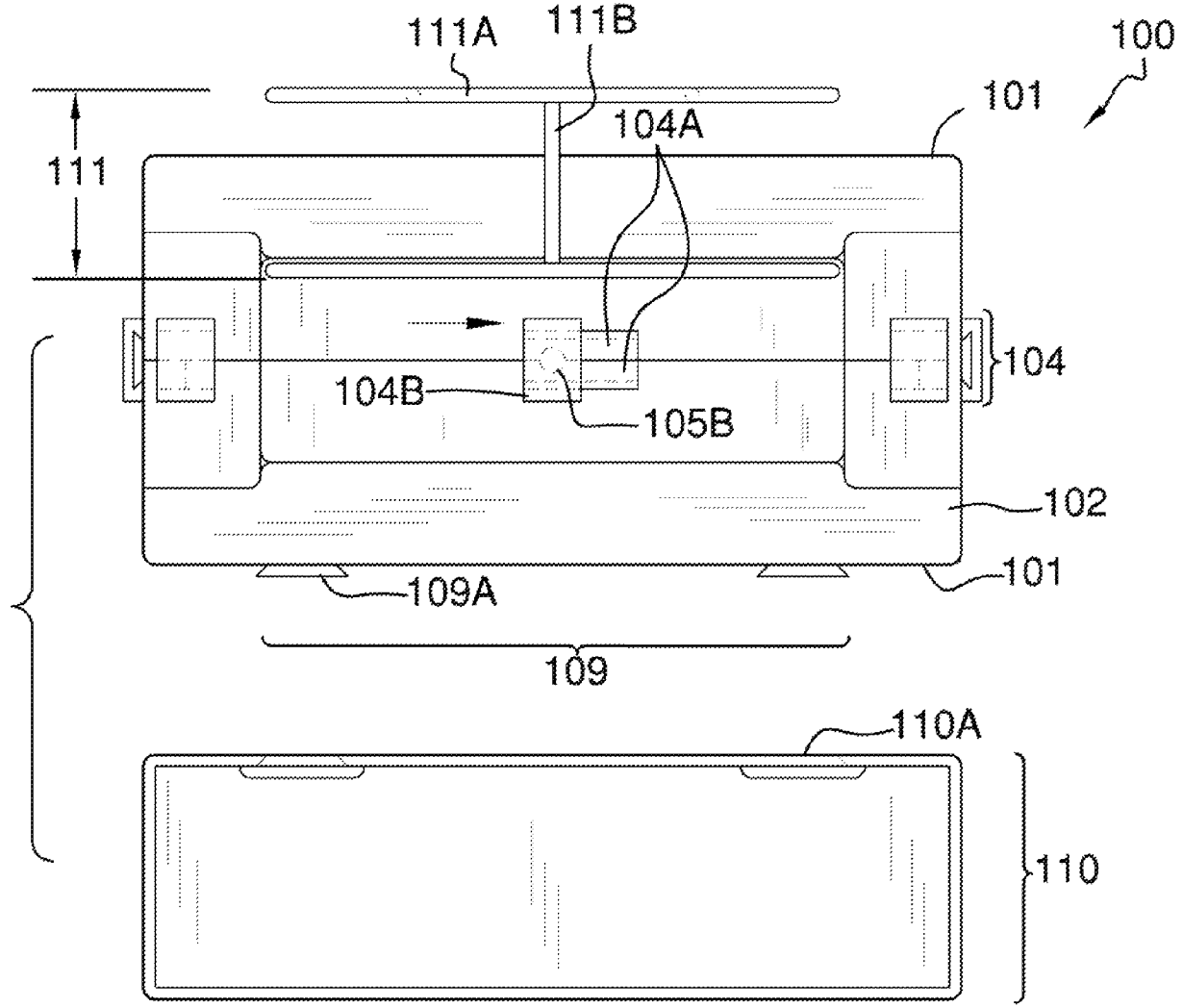
FIG. 3 illustrates a top view of the paint carrier and organizer in which a sliding lock is provided atop of the container such that the hole for access of a paint roller may be obstructed when so needed.
Figure 4:
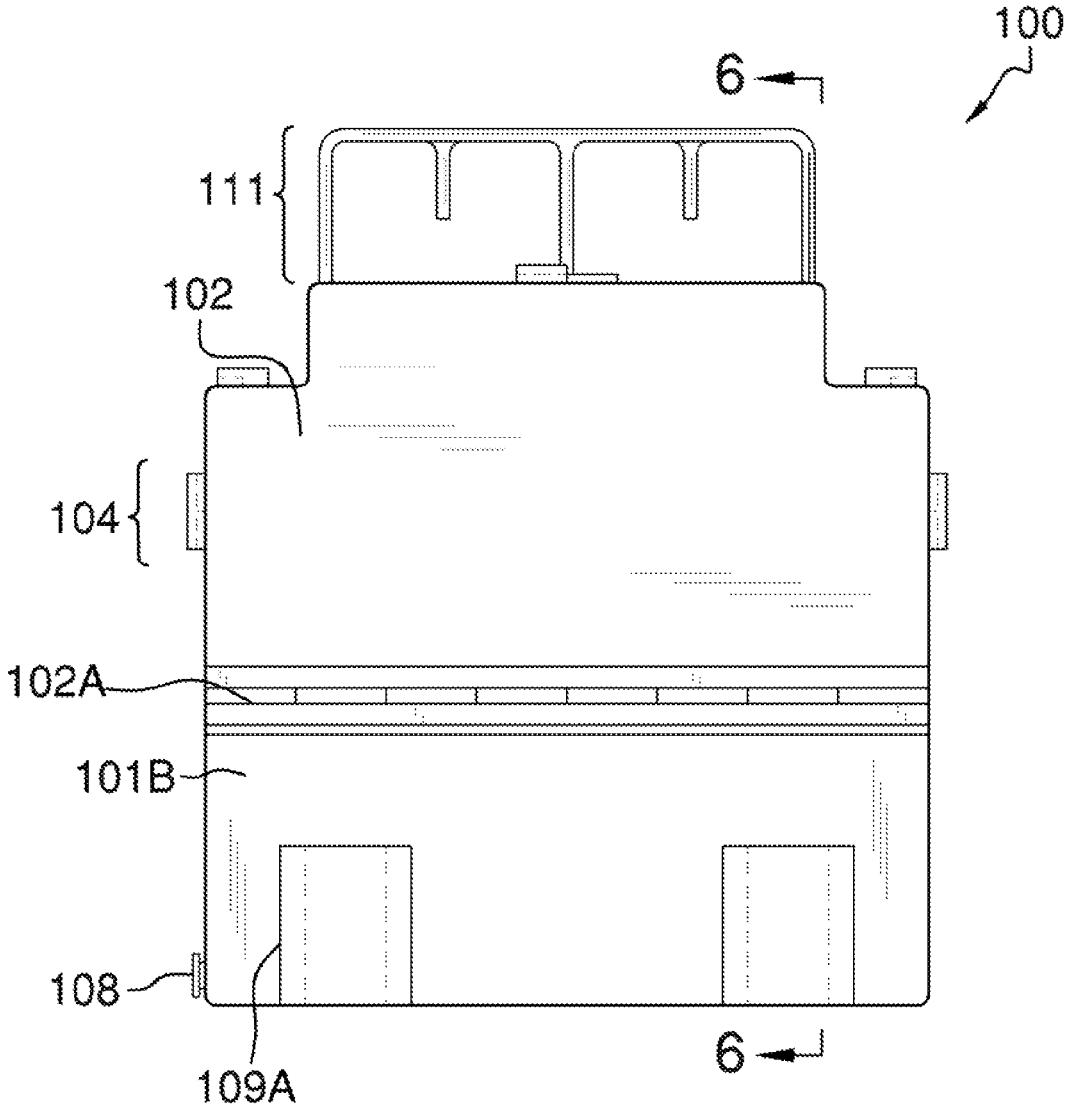
FIG. 4 illustrates a front view of the paint carrier and organizer in which the removable storage container mounts adorn a front, exterior of the container.

It shall be noted that a sliding lock 104 may be provided with respect to the hole 105B so as to seal off the hole 105B when not in use (see FIG. 3). More specifically, two protruding members 104A are provided at the hole 105B and work in conjunction with a sliding member 104B.

The container 101 may include a plug 108 that is provided at or near a bottom portion of the container 101 such that the contents of the container 101 may be removed. More specifically, the plug 108 may be removed to assist in washing out paint 130 stored within, and as desired by an end user.

Adorning a front surface 101B of the container 101 is a mount 109, which works in conjunction with a removable storage container 110 to accessorize the invention 100. The mount 109 is constructed of a protrusion extending outwardly from the front surface 101B of the container 101, which enables a grooved track 110A located on the removable storage container 110 to slide thereon or therefrom as desired by an end user.

The removable storage container 110 is a hollow structure, which enables paint tools or other tools to be stored adjacent the container 101, and which may or may not be used in conjunction with painting.

Hanging hooks 111 extend upwardly and rearwardly from the container 101 to provide a means for supporting the invention upon a ladder rung 140 of a ladder 141. The hanging hooks feature two inverted members 111A that are generally parallel and are interconnected via a lateral member 111B. It shall be noted that due to the design of the hanging hooks 111, the invention 100 may be hung along any of the ladder rungs 140 of said ladder 141, and including a top rung 140A provided holes 140' are included for the hanging hooks 111 to engage upon.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A paint carrier and organizer comprising:

a container from which a hinged member attaches via a hinge and rotates to either open or close off an opening located on the container in order to store or supply paint contained therein;

wherein the hinged member and container include a tongue and groove along a perimeter of said opening in order to provide a watertight seal when closed off;

wherein a hanging hooks extend from said container to enable the paint carrier and organizer to be hung upon a ladder rung;

wherein paint tool securing means are provided to store a paint tool within the container between uses;

wherein the paint tool securing means includes a hole formed between the container and the hinged member such that a paint roller may be secured thereon by enabling a handle of said paint roller to rest atop of said hole while the remaining portion of the paint roller hangs below and within the interior of the container and the hinged member;

wherein a sliding lock is provided at said hole; wherein the sliding lock includes two protruding members located on both the container and the hinged member, and when pressed adjacent one another, a sliding member shall slide there over, and thereby prevent separation there between.

2. The paint carrier and organizer as described in claim 1 wherein the opening is located along a top, front portion of the container.

3. The paint carrier and organizer as described in claim 1 wherein the tongue and groove seal is further defined with a tongue member and a groove member that align and with and marry together to form said watertight seal.

4. The paint carrier and organizer as described in claim 3 wherein the tongue member is provided on either the container or the hinged member; whereas the groove member is provided be on either the hinged member or the container, respectively.

5. The paint carrier and organizer as described in claim 1 wherein a plurality of sliding locks are provided on the container and hinged member, and shall secure and seal the tongue and groove seal.

6. The paint carrier and organizer as described in claim 5 wherein the sliding locks are each comprised of two protruding members located on both the container and the hinged member, and when pressed adjacent one another, a sliding member shall slide there over, and thereby prevent separation there between.

7. The paint carrier and organizer as described in claim 1 wherein the paint tool securing means includes a paintbrush having at least one magnet that attracts to a magnet provided along an interior surface of either the container or the hinged member.

8. The paint carrier and organizer as described in claim 1 wherein the container include a plug located at or near a bottom portion of the container such that the contents are extracted there from.

9. The paint carrier and organizer as described in claim 1 wherein adorning a front surface of the container is a mount that works to support a removable storage container thereon.

10. The paint carrier and organizer as described in claim 9 wherein the mount is composed of a protrusion extending outwardly from the front surface of the container, which enables a grooved track located on the removable storage container to slide thereon or therefrom as desired by an end user.

11. A paint carrier and organizer comprising:

a container from which a hinged member attaches via a hinge and rotates to either open or close off an opening located on the container in order to store or supply paint contained therein;

wherein the hinged member and container include a tongue and groove along a perimeter of said opening in order to provide a watertight seal when closed off;

wherein a hanging hooks extend from said container to enable the paint carrier and organizer to be hung upon a ladder rung;

wherein paint tool securing means are provided to store a paint tool within the container between uses;

wherein the opening is located along a top, front portion of the container;

wherein the tongue and groove seal is further defined with a tongue member and a groove member that align and with and marry together to form said watertight seal; wherein the tongue member is provided on either the container or the hinged member; whereas the groove member is provided be on either the hinged member or the container, respectively;

wherein a plurality of sliding locks are provided on the container and hinged member, and shall secure and seal the tongue and groove seal; wherein the sliding locks are each comprised of two protruding members located on both the container and the hinged member, and when pressed adjacent one another, a sliding member shall slide there over, and thereby prevent separation there between;

wherein the paint tool securing means includes a paint-brush having at least one magnet that attracts to a magnet provided along an interior surface of either the container or the hinged member;

wherein the paint tool securing means includes a hole formed between the container and the hinged member such that a paint roller may be secured thereon by enabling a handle of said paint roller to rest atop of said hole while the remaining portion of the paint roller hangs below and within the interior of the container and the hinged member;

wherein a sliding lock is provided at said hole; wherein the sliding lock includes two protruding members located on both the container and the hinged member, and when pressed adjacent one another, a sliding member shall slide there over, and thereby prevent separation there between.

12. The paint carrier and organizer as described in claim 11 wherein the container include a plug located at or near a bottom portion of the container such that the contents are extracted there from.

13. The paint carrier and organizer as described in claim 12 wherein adorning a front surface of the container is a mount that works to support a removable storage container thereon; wherein the mount is composed of a protrusion extending outwardly from the front surface of the container, which enables a grooved track located on the removable storage container to slide thereon or therefrom as desired by an end user.

* * * * *